US007007774B2

(12) United States Patent
Utsunomiya et al.

(10) Patent No.: US 7,007,774 B2
(45) Date of Patent: Mar. 7, 2006

(54) ACTIVE HORIZONTAL VIBRATION REDUCING DEVICE FOR ELEVATOR

(75) Inventors: Kenji Utsunomiya, Tokyo (JP); Kenichi Okamoto, Tokyo (JP); Takashi Yumura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 210 days.

(21) Appl. No.: 10/622,784

(22) Filed: Jul. 21, 2003

(65) Prior Publication Data

US 2004/0020725 A1 Feb. 5, 2004

(30) Foreign Application Priority Data

Jul. 29, 2002 (JP) ..... 2002-219496

(51) Int. Cl.
*B66B 1/34* (2006.01)

(52) U.S. Cl. ..... 187/292; 187/391

(58) Field of Classification Search ..... 187/391, 187/393, 292, 278, 409
See application file for complete search history.

(56) References Cited

U.S. PATENT DOCUMENTS 5,092,625 A * 3/1992 Kawabata ..... 280/5.501
5,117,946 A * 6/1992 Traktovenko et al. ..... 187/410
5,824,976 A 10/1998 Jamieson et al.
5,896,949 A 4/1999 Hamdy et al.
5,929,399 A * 7/1999 Jamieson et al. ..... 187/391
5,959,266 A * 9/1999 Uchiumi ..... 187/292
6,401,872 B1 * 6/2002 Morishita ..... 187/292
6,474,449 B1 11/2002 Utsunomiya et al.
6,763,917 B1 * 7/2004 Utsunomiya et al. ..... 187/292
2003/0226717 A1 * 12/2003 Husmann ..... 187/292
2004/0134716 A1 * 7/2004 Martinelli ..... 187/292

FOREIGN PATENT DOCUMENTS

JP 03051281 A * 3/1991
JP 8-333068 12/1996
JP 08-333068 12/1996
JP 10-279214 10/1998

* cited by examiner

*Primary Examiner*—Jonathan Salata
(74) *Attorney, Agent, or Firm*—Leydig, Voit & Mayer, Ltd.

(57) ABSTRACT

An elevator vibration reducing device in which horizontal vibrations of a cage are detected by a vibration sensor. The cage is displaced horizontally by an actuator. A control portion for controlling the actuator has a computing portion for computing a vibration reduction control signal for reducing the horizontal vibrations of the cage based on a vibration detection signal generated by the vibration sensor. The control portion has a detection signal comparing portion for comparing a detection value obtained from the vibration detection signal with a previously set value, and stopping controlling of the actuator when the detection value becomes no less than the set value.

7 Claims, 10 Drawing Sheets

ACTIVE HORIZONTAL VIBRATION REDUCING DEVICE FOR ELEVATOR

BACKGROUND OF THE INVENTION

1. Field of the Invention

The present invention relates to an elevator vibration reducing device which actively reduces horizontal vibrations of a car in an elevator system.

2. Description of the Related Art

As a result of the recent increase in building height, high-speed/high-lift elevators have been developed. In such high-speed/high-lift elevators, an improvement in terms of riding comfort is among the technical concerns involved. In particular, one of the important issues is how to mitigate rolling (horizontal vibrations) of the car. Rolling of the car is attributable to an insufficient degree of straightness of the guide rails, rolling of the wire rope, fluctuations in wind pressure during the traveling of the car, etc. All of those factors become more serious as the speed and lift of the elevator become higher.

To cope with this, up to now, there has been proposed a so-called active type vibration reducing device (roller guide device), which detects the horizontal acceleration of the car and applies a force to a guide roller so as to cancel this acceleration to thereby reduce the horizontal vibrations. This active type vibration reducing device, however, has a rather complicated control device including a controller, power amplifier, etc, which may lead to an occurrence of a trouble such as failure and malfunction.

For example, JP 08-333068 A discloses a device in which the output of a detecting device and a set value are compared with each other in each operation mode to thereby detect any failure. Further, JP10-279214 A discloses a device which makes a judgment as to whether the gap between an actuator coil and a reaction bar is within a permissible range or not. The former device makes a judgment as to whether active control is being executed or not, whereas the latter device makes a judgment as to whether the result of active control is within a permissible range or not.

The above-mentioned conventional active type vibration reducing devices have a problem in that, for example, when the passenger jumps about in the car, the resultant vibration of the car may cause generation of a transient signal in the active type vibration reducing device, thereby damaging the active type vibration reducing device. Further, if the device should be out of order, the passenger would suffer loss of riding comfort.

SUMMARY OF THE INVENTION

The present invention has been made with a view toward solving the above problem in the prior art. It is an object of the present invention to provide an elevator vibration reducing device capable of protecting the active control apparatus from a current or voltage in excess of a permissible value and of maintaining the riding comfort for the passenger if the device should be out of order.

To this end, according to one aspect of the present invention, there is provided an elevator vibration reducing device in which a control portion for controlling an actuator has a computing portion for performing computation, based on a vibration detection signal from a vibration sensor, of a vibration reduction control signal for reducing horizontal vibrations of the cage. The control portion has a detection signal comparing portion for comparing a detection value indicated by the vibration detection signal with a previously-set value, the control of the actuator being stopped when the detection value has become equal to or larger than the previously-set value.

Due to the above arrangement, the active control apparatus is protected from a current/voltage in excess of the permissible value.

According to another aspect of the present invention, there is provided an elevator vibration reducing device in which a control portion is equipped with current restricting means for restricting a value of a current output from a power amplifier to an actuator. The power amplifier is equipped with a current comparing portion which stops an output of a vibration reduction control signal to the actuator when a value of a current output from the power amplifier to the actuator is not smaller than a previously set value.

Due to the above arrangement, if current restricting means should become out of order, it is possible to prevent an excessive current from flowing to the actuators, thereby preventing damage to the active control devices.

According to a still further aspect of the present invention, there is provided an elevator vibration reducing device in which a control portion has a plurality of detection signal comparing portions for comparing detection values obtained from vibration detection signals with previously set values and a branching portion for assigning the vibration detection signals to the detection signal comparing portions corresponding to the respective frequencies thereof. The set values in the detection signal comparing portions are different from each other according to frequency bands corresponding thereto. The control portion stops the control of an actuator when the detection values have become equal to or larger than the set values.

Due to the above arrangement, error checking is performed with the frequency band divided, so that it is possible to prevent the vibration due to the traveling of a car, a prank, etc. from being judged to be a failure, thus making it possible to make failure judgment more reliably.

According to a still further aspect of the present invention, there is provided an elevator vibration reducing device in which a control portion has a multiple sensor output comparing portion for making failure judgment on vibration sensors by comparing vibration detection signals. The control portion stops a control of an actuator when the vibration sensors are judged to be out of order.

Due to the above arrangement, it is possible to quickly detect a failure in the acceleration sensors.

According to a still further aspect of the present invention, there is provided an elevator vibration reducing device which includes an inspecting portion having an inspection signal generating portion for outputting an inspection signal to the control portion so as to drive the actuator when the cage is at rest and an abnormality judging portion for making abnormality judgment by comparing a vibration detected by the vibration sensor when the inspection signal is output with a vibration directly obtained from the inspection signal.

Due to the above arrangement, it is possible to easily make a diagnosis of whether an active control system operates in the normal fashion or not.

DETAILED DESCRIPTION OF THE PREFERRED EMBODIMENTS

Embodiments of the present invention will now be described with reference to the drawings.

Embodiment 1

Figure 1:
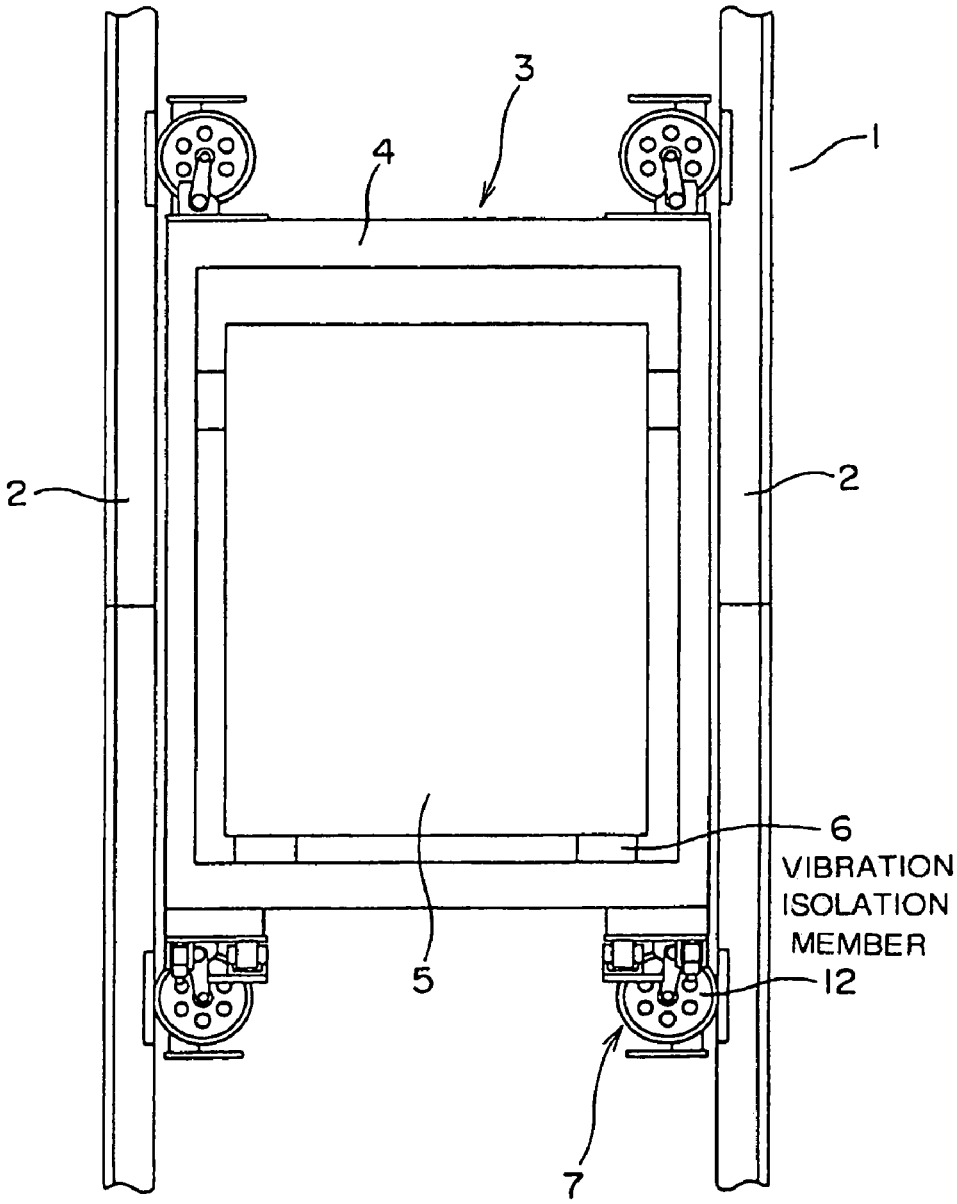
FIG. 1 is a front view of a car of an elevator according to Embodiment 1 of the present invention.

FIG. 1 is a front view of the car of an elevator according to Embodiment 1 of the present invention. In the drawing, a pair of guide rails 2 are installed in a hoistway 1. The guide rails 2 are fixed to the hoistway wall through the intermediation of brackets (not shown). A car 3 is guided by the guide rails 2 in its ascent and descent in the hoistway 1.

The car 3 has a car frame 4, a cage 5 supported by the car frame 4, and a plurality of vibration-isolating members 6 provided between the car frame 4 and the cage 5. Mounted on top of and under the car frame 4 are four roller guide devices 7. The roller guide devices 7 are engaged with the guide rails 2 to guide the car 3 in its ascent and descent.

Figure 2:
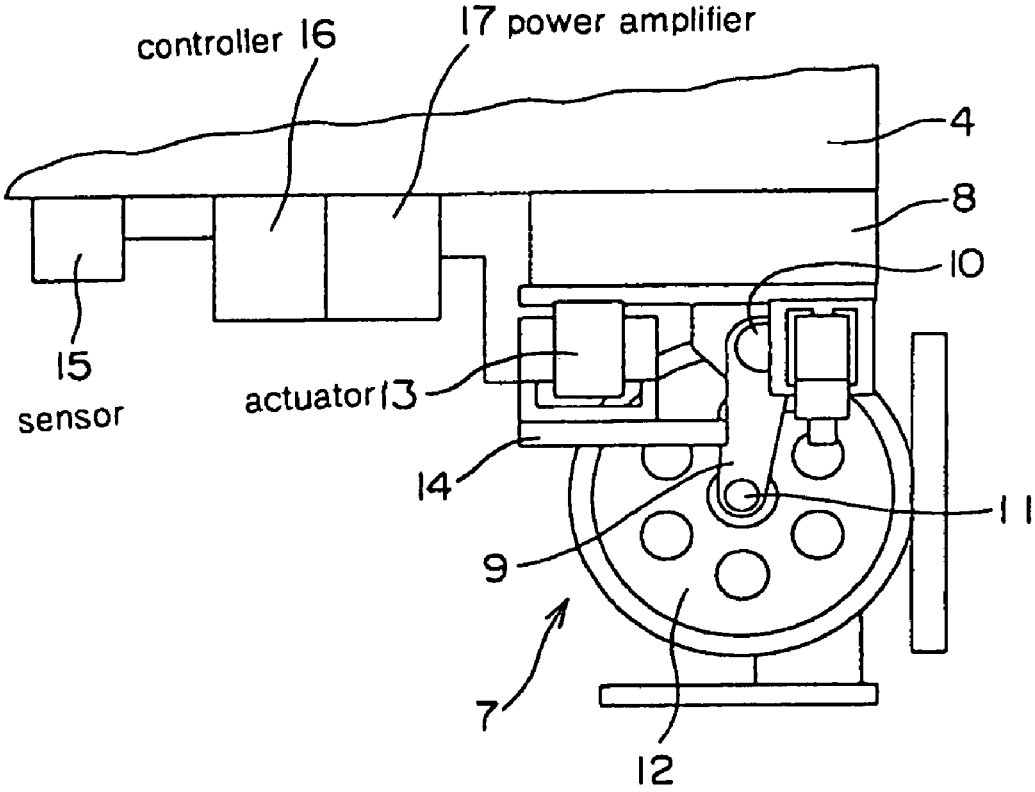
FIG. 2 is a side view of a roller guide device shown in FIG. 1.

FIG. 2 is a side view of one of the roller guide devices 7 of FIG. 1. As shown in the drawing, bases 8 are fixed to the car frame 4. A plurality of roller levers 9 are respectively mounted to the bases 8. Each roller lever 9 is capable of swinging around a shaft 10 extending horizontally.

Provided at the forward end of each roller lever 9 is a guide roller 12 rotatable around an axle 11 extending parallel to the shaft 10. Each set of roller guide device 7 is equipped with three guide rollers 12. The guide rollers 12 roll on the guide surfaces of the guide rails 2 as the car 3 ascends or descends. Further, the guide rollers 12 can be displaced in the horizontal direction with respect to the car 3 by swinging the roller levers 9.

Mounted on the base 8 are a plurality of electromagnetic actuators (voice coil motors) 13 for displacing the guide rollers 12 horizontally with respect to the car 3. Connected between the movable portions of the electromagnetic actuators 13 and the roller levers 9 are arms 14 for transmitting the driving force of the electromagnetic actuators 13 to the roller levers 9.

Mounted on the car frame 4 is an acceleration sensor 15 serving as a vibration sensor for detecting the horizontal acceleration of the car 3. Connected to the acceleration sensor 15 is a control portion (controller) 16 for controlling the electromagnetic actuators 13. The control portion 16 computes and outputs a vibration reduction control signal for reducing horizontal vibrations of the car 3 from an acceleration detection signal (vibration detection signal) supplied from the acceleration sensor 15. Connected between the control portion 16 and the electromagnetic actuators 13 is a power amplifier 17. The power amplifier 17 amplifies the vibration reduction control signal and outputs it to the electromagnetic actuators 13. The vibration reducing device of Embodiment 1 has the electromagnetic actuators 13, the arms 14, the acceleration sensor 15, the control portion 16, and the power amplifier 17.

Figure 3:
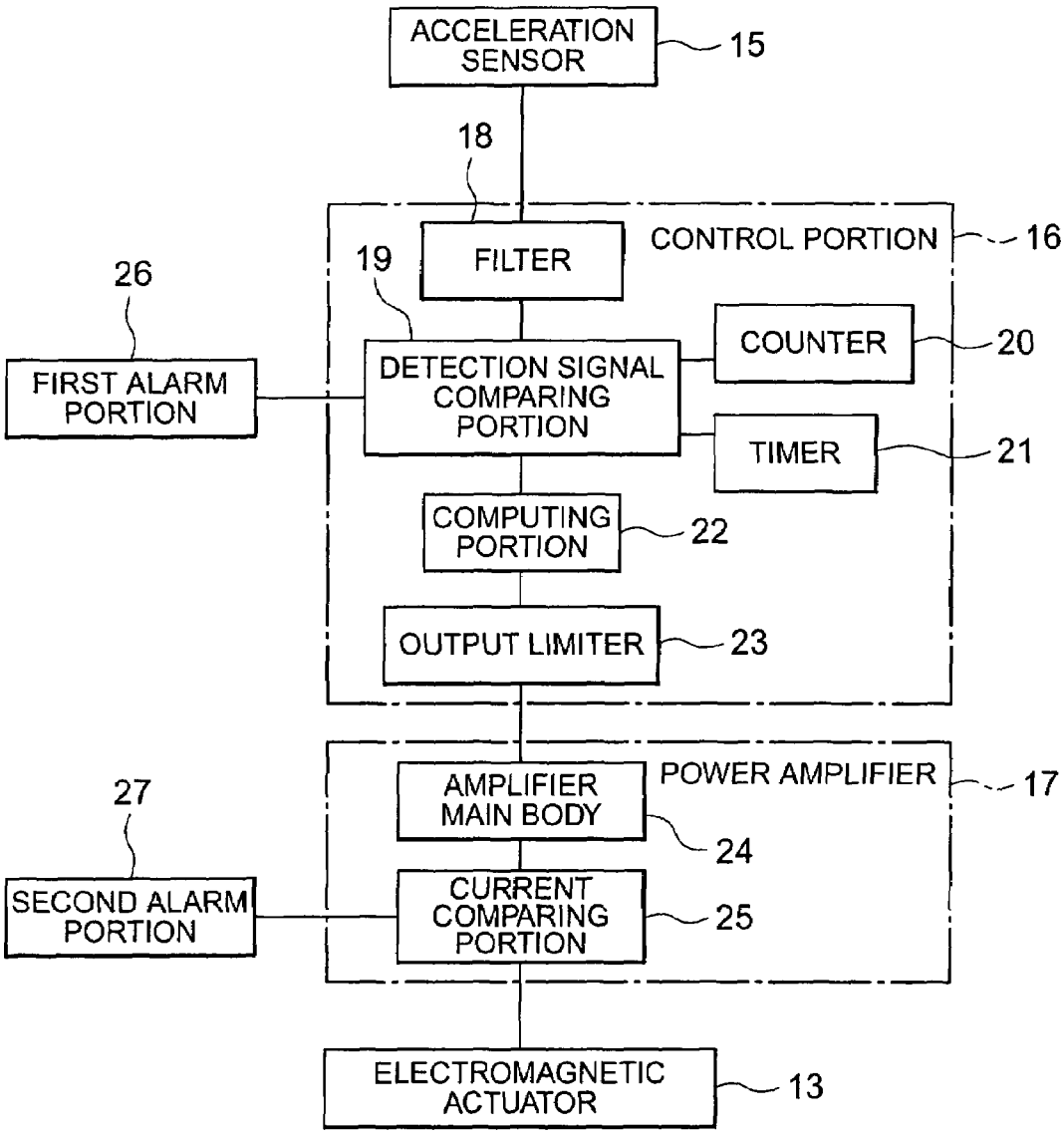
FIG. 3 is a block diagram showing a main portion of a vibration reducing device of FIG. 2.

FIG. 3 is a block diagram showing a main portion of the vibration reducing device of FIG. 2. The control portion 16 has a filter (band-pass filter) 18, a detection signal comparing portion 19, a counter 20, a timer 21, a computing portion 22, and an output limiter 23.

Of the acceleration detection signals input to the control portion 16 from the acceleration sensor 15, the signals outside the control frequency band are intercepted by the filter 18, and only the signals of the control frequency band are allowed to pass. The control band corresponds to the frequency of a vibration noticeable to the passenger (e.g., 0.5 to 30 Hz), and active control is executed on a vibration within the control band.

The acceleration detection signals having passed through the filter 18 are input to the detection signal comparing portion 19. In the detection signal comparing portion 19, a detection value obtained from an acceleration detection signal is compared with a previously set value. And, when the detection value has become equal to or larger than the set value, the control on the electromagnetic actuators 13, that is, the active control, is stopped.

In the counter 20, the number of times that the detection value has become equal to or larger than the set value (the number of times that abnormality has been detected) is counted. In the timer 21, the period of time that has elapsed since the stopping of the active control is measured. The acceleration detection signal having passed through the detection signal comparing portion 19 is input to the computing portion 22, where a vibration reduction control signal is obtained through computation.

The vibration reduction control signal from the computing portion 22 is input to the output limiter 23 serving as a current restricting means. The output limiter 23 restricts the current value output from the power amplifier 17 to the electromagnetic actuator 13. That is, a vibration reduction control signal of a value not larger than an upper limit value previously set in the output limiter 23 is allowed to pass through the output limiter 23 as it is, and is output to the power amplifier 17. A vibration reduction control signal in excess of the upper limit value is output to the power amplifier 17 as the upper limit value.

The power amplifier 17 has an amplifier main body 24 amplifying a vibration reduction control signal and a current comparing portion 25. The current comparing portion 25 restricts the current value output from the power amplifier 17 to the electromagnetic actuators 13. That is, in the current comparing portion 25, an output current corresponding to the vibration reduction control signal and a previously set value are compared with each other; when the current value is smaller than the set value, the vibration reduction control signal is output to the amplifier main body 24. When the current value corresponding to the vibration reduction control signal is equal to or larger than the set value, the output of the vibration reduction control signal to the amplifier main body 24 is stopped. This current comparing portion 25 may consist, for example, of a breaker or a fuse.

A first alarm portion 26 is connected to the detection signal comparing portion 19 of the control portion 16. A second alarm portion 27 is connected to the current comparing portion 25 of the power amplifier 17.

Figure 4:
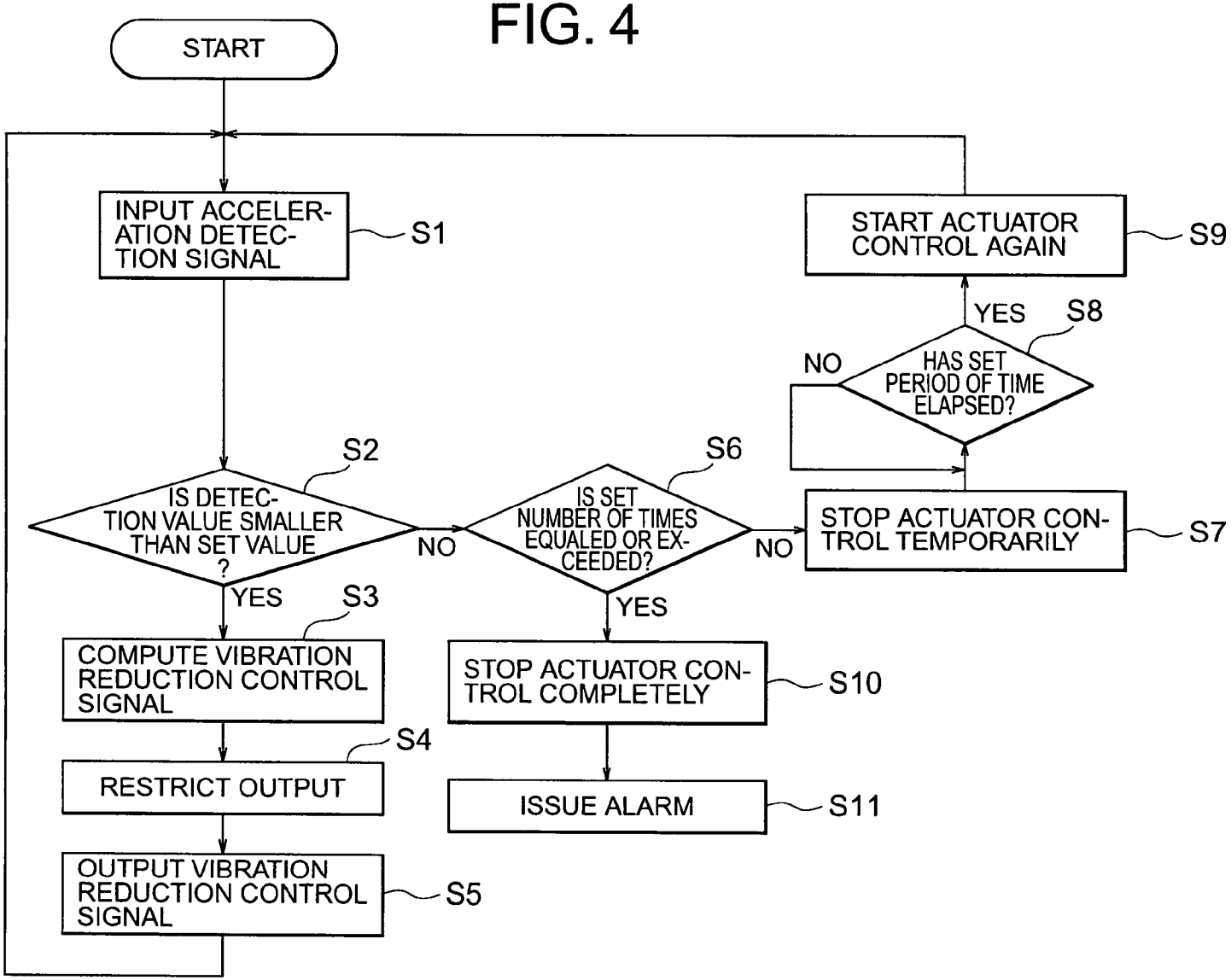
FIG. 4 is a flowchart for illustrating the operation of a control portion of FIG. 3.

Next, the operation of this device will be described. FIG. 4 is a flowchart for illustrating the operation of the control portion 16 of FIG. 3. During operation of the elevator, an acceleration detection signal from the acceleration sensor 15 is constantly input (step S1). The acceleration detection signal having passed the filter 18 is compared with a set value in the detection signal comparing portion 19. More specifically, a judgment is made as to whether the detection value obtained from the acceleration detection signal is less than a previously set value (e.g., 1 m/s2) or not (step S2).

When the detection value is less than the set value, a vibration reduction control signal is computed by the computing portion 22 (step S3). As described above, the vibration reduction control signal is restricted in output by the output limiter 23 (step S4), and is output to the power amplifier 17 (step S5).

When the detection value is not less than the set value, the counter 20 counts the number of times that the set value has been equaled or exceeded. And, a judgment is made in the detection signal comparing portion 19 as to whether the number of times that the detection value has equaled or exceeded the set value is not less than a set number (e.g., three times) or not (step S6). When the set number of times has not been attained, the active control on the electromagnetic actuators 13 is temporarily stopped. That is, the active control is stopped temporarily for a vibration of a large amplitude which is not less than a set value (step S7).

At the same time, the period of time that has elapsed since the temporary stopping of the active control is measured by the timer 21. And, the detection signal comparing portion 19 monitors whether the time that has elapsed has attained a predetermined period of time or not (step S8). When the set period of time has elapsed, the active control on the electromagnetic actuators 13 is started again (step S9).

When the number of times that the detection value of the acceleration has equaled or exceeded the set value has attained the set number of times, the active control on the electromagnetic actuators 13 is completely stopped (step S10). And, an abnormality detection signal is output from the detection signal comparing portion 19 to the first alarm portion 26, and an alarm is given to the elevator control room, the elevator maintenance company or the like (step S11).

As described above, the control method is switched according to the number of times that the acceleration detection value has equaled or exceeded the set value. That is, when the number of times that the acceleration detection value has equaled or exceeded the set value is less than the set number of times, it is considered as a temporary abnormal vibration due to a prank or the like on the part of the passenger, and the active control is stopped just temporarily. On the other hand, an abnormal vibration in which the set number of times is exceeded is considered as one due to failure of the apparatus, etc. In that case, the active control is stopped completely, in which case inspection is waited for.

Figure 5:
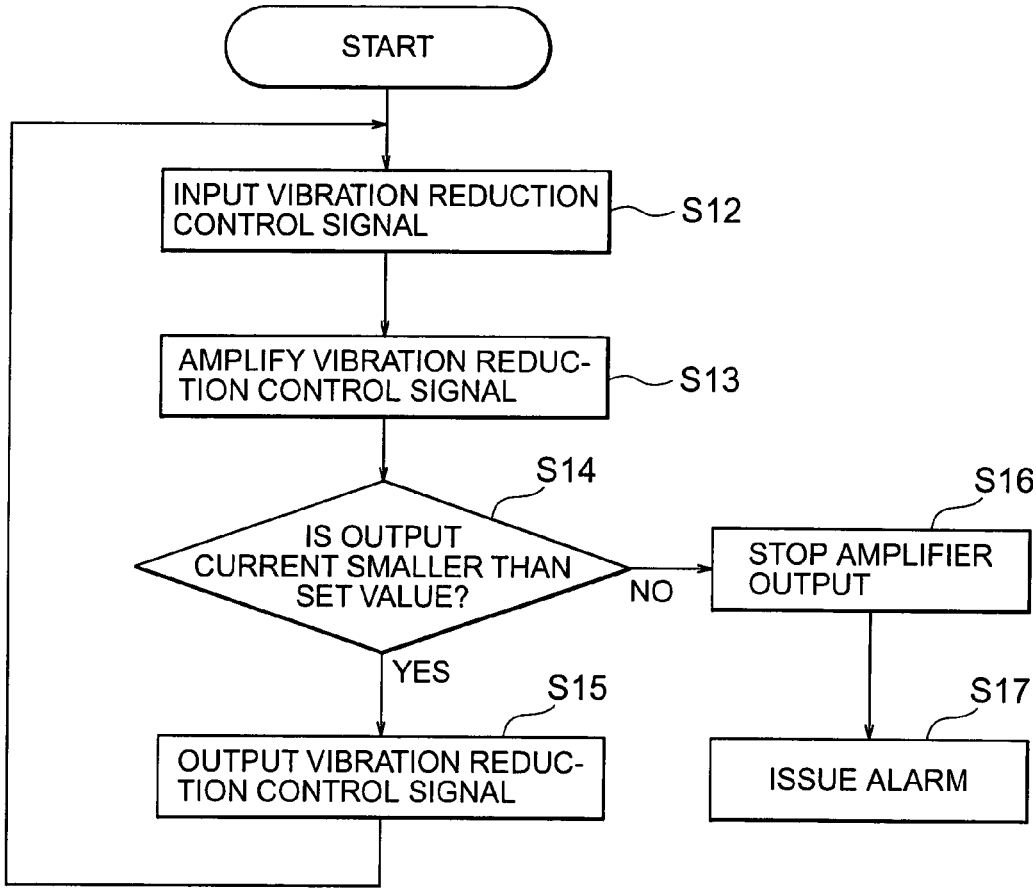
FIG. 5 is a flowchart for illustrating the operation of a power amplifier of FIG. 3.

Next, FIG. 5 is a flowchart for illustrating the operation of the power amplifier 17 of FIG. 3. When a vibration reduction control signal is input to the power amplifier 17 from the control portion 16 (step S12), the vibration reduction control signal is amplified by the amplifier main body 24 (step S13).

Thereafter, a judgment is made by the current comparing portion 25 as to whether the output current corresponding to the vibration reduction control signal is less than a set value (e.g.,2A) or not (step S14). When the output current is less than the set value, it is output to the electromagnetic actuators 13 (step S15), and active control is executed.

On the other hand, when it is determined that the output current is not less than the set value, the current output to the electromagnetic actuators 13 is stopped (step S16), and flowing of an excessive current to the electromagnetic actuators 13 is prevented. Further, an abnormality detection signal is output from the current comparing portion 25 to the second alarm portion 27, and an alarm is given from the second alarm portion 27 to the elevator control room, the elevator maintenance company or the like (step S17).

The driving force of the electromagnetic actuators 13 is transmitted to the roller levers 9 through the arms 14, and the roller levers 9 are swung around the shafts 10. As a result of the swinging of the roller levers 9, the guide rollers 12 are displaced horizontally with respect to the car 3. In the active control, the guide rollers 12 are displaced so as to cancel the horizontal vibrations of the car 3, thereby mitigating the vibration of the car 3.

In this vibration reducing device, the detection value obtained from the acceleration detection signal is compared with the previously set value, and the control of the electromagnetic actuators 13 is stopped when the detection value has become not less than the set value, so that damage to the active control devices, such as the power amplifier 17 and the electromagnetic actuators 13, attributable to excessive vibrations is prevented. Further, if the device should become out of order, the riding comfort for the passenger can be maintained.

Further, not only is the control portion 16 provided with the output limiter 23, but also the power amplifier 17 is provided with the current comparing portion 25, so that, if the output limiter 23 should become out of order, it is possible to prevent an excessive current from flowing to the electromagnetic actuators 13, thereby preventing damage to the active control devices.

Further, when it is determined that the output current is not less than the set value, the current output to the electromagnetic actuators 13 is stopped, and an alarm is issued by the second alarm portion 27, whereby any abnormality in the control portion 16 can be known quickly.

Furthermore, since the control portion 16 is provided with the filter 18 to restrict the frequency band of the vibration for the active control, it is possible to perform the active control more efficiently, whereby riding comfort can be effectively improved.

Further, for a temporary abnormal vibration, the active control is stopped temporarily, and started again after the set period of time has elapsed, so that it is possible to minimize a deterioration in riding comfort due to the stopping of the active control. Further, for a continuous abnormal vibration, the active control is completely stopped, and an alarm is issued, so that damage to the devices due to the abnormal vibration is prevented, and it is possible to quickly restore the active restricting function.

Embodiment 2

Figure 6:
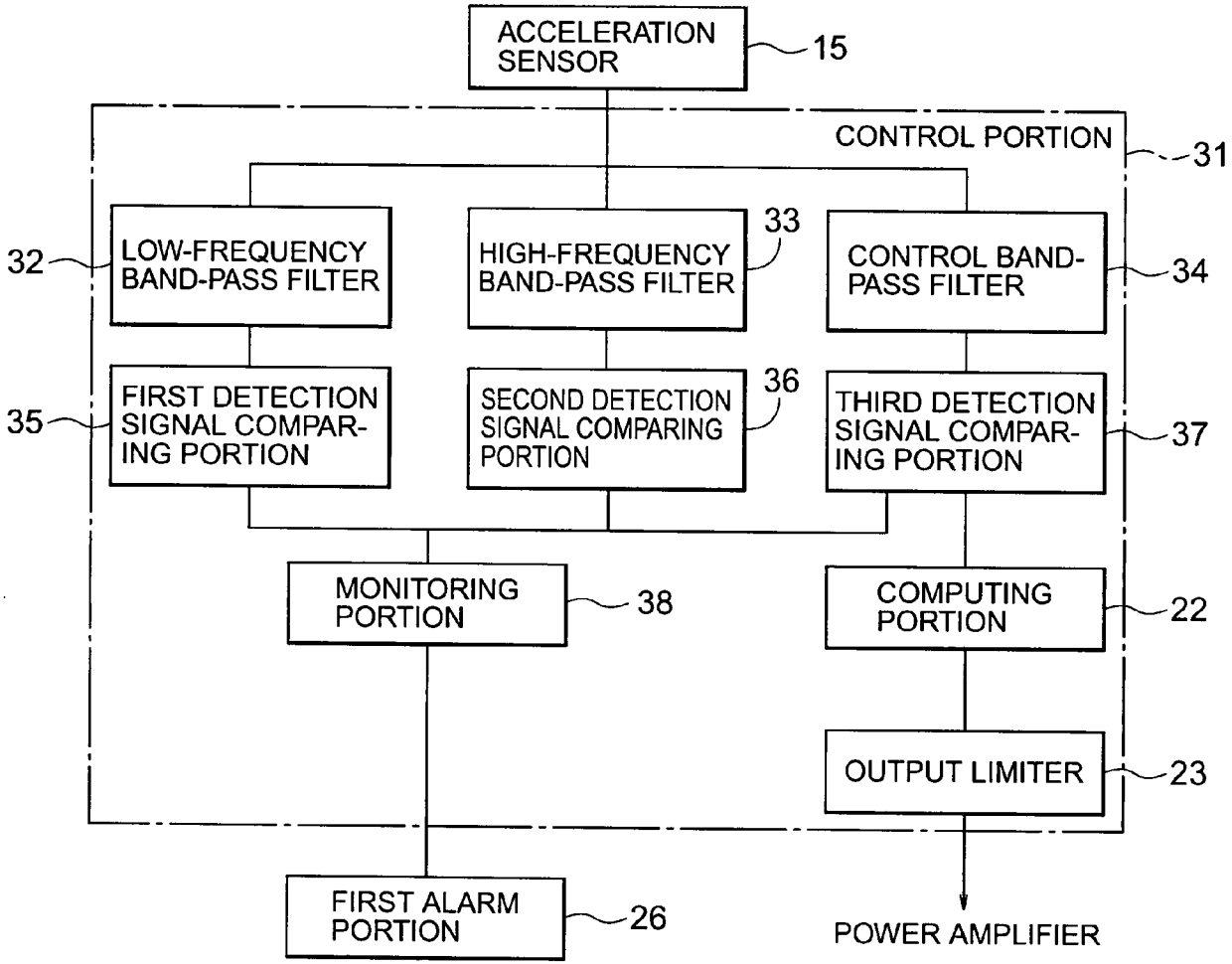
FIG. 6 is a block diagram showing a main portion of a vibration reducing device according to Embodiment 2 of the present invention.

Next, FIG. 6 is a block diagram showing a main portion of a vibration reducing device according to Embodiment 2 of the present invention. In the drawing, a control portion 31 has a low-frequency band-pass filter 32, a high-frequency band-pass filter 33, a control band-pass filter 34, a first detection signal comparing portion 35, a second detection signal comparing portion 36, a third detection signal comparing portion 37, a monitoring portion 38, a computing portion 22, and an output limiter 23.

An acceleration detection signal from the acceleration sensor 15 is input to the low-frequency band-pass filter 32, the high-frequency band-pass filter 33, and the control band-pass filter 34. The low-frequency band-pass filter 32 is a band-pass filter which only allows signals of a low-frequency band (e.g., DC to 1 Hz) to pass. The high-frequency band-pass filter 33 is a band-pass filter which only allows signals of a high-frequency band (e.g., 20 Hz or more) to pass. The control band-pass filter 34 is a band-pass filter which only allows signals of a control frequency band (e.g., 0.5 to 30 Hz) to pass.

Connected to the low-frequency band-pass filter 32 is the first detection signal comparing portion 35. Connected to the high-frequency band-pass filter 33 is the second detection signal comparing portion 36. Connected to the control band-pass filter 34 is the third detection signal comparing portion 37. A branch portion for assigning acceleration detection signals to the detection signal comparing portions 35 through 37 according to their frequencies has the low-frequency band-pass filter 32, the high-frequency band-pass filter 33, and the control band-pass filter 34.

In each of the first through third detection signal comparing portions 35 through 37, a detection value obtained from an acceleration detection signal is compared with a previously set value (error level). And, when the detection value becomes equal to or larger than the set value in at least one of the detection signal comparing portions 35 through 37, the monitoring portion 38 detects that, and the control on the electromagnetic actuators 13, that is, the active control, is stopped.

The set values in the detection signal comparing portions 35 through 37 differ from each other according to the frequency bands corresponding thereto. A vibration caused by a prank in the car 3 (FIG. 1) is a vibration within the control frequency band, so that, the set value in the third detection signal comparing portion 37 corresponding to the control frequency band is high (e.g., 150 Gal), whereby it is possible to reduce the possibility of erroneous detection due to pranks or the like.

A destabilizing vibration in active control is generated in a region near the upper-limit frequency of the control band. Thus, the set value in the second detection signal comparing portion 36 corresponding to the high-frequency band is low (e.g., 50 Gal), whereby it is possible to detect a reduction in destabilization more quickly and stop the control safely.

Further, in this example, to reliably allow passage of a vibration near the control band upper limit (which is 30 Hz in this example), the frequency band corresponding to the high-frequency band-pass filter 33 overlaps a part of the frequency band corresponding to the control band filter 34 (near the upper limit).

Furthermore, when the acceleration sensor 15 is normally operating, substantially no acceleration detection signal of the low-frequency band is generated. Thus, an acceleration detection signal of the low-frequency band can be utilized as a signal indicating a failure of the acceleration sensor 15 other than destabilizing vibration. Otherwise, the construction and operation of this embodiment is the same as those of Embodiment 1.

In Embodiment 1, failure judgment is made only with respect to signals of the control band, so that the programming is easy and the mounting to the control portion 16 can be easily effected. However, as compared with Embodiment 2, it is necessary for the set value in the control band to be set lower, so that the possibility of occurrence of erroneous detection due to pranks or the like is rather high. In view of this, a recovery circuit is provided; however, the active control has to be suspended until recovery.

In contrast, in the vibration reducing device of Embodiment 2, error checking is performed with the frequency band divided, so that it is possible to prevent the vibration due to the traveling of the car 3, a prank, etc. from being judged to be a failure, thus making it possible to make failure judgment more reliably. Further, instability in control, a failure in the acceleration sensor 15, etc. can be dealt with more quickly.

When any abnormality is detected by the monitoring portion 38, the active control may be stopped completely. However, as shown in the flowchart of FIG. 4, it is also possible to count the number of times that abnormality has been detected, and automatically recover the active control when the number of times counted is less than the set number of times.

Embodiment 3

Figure 7:
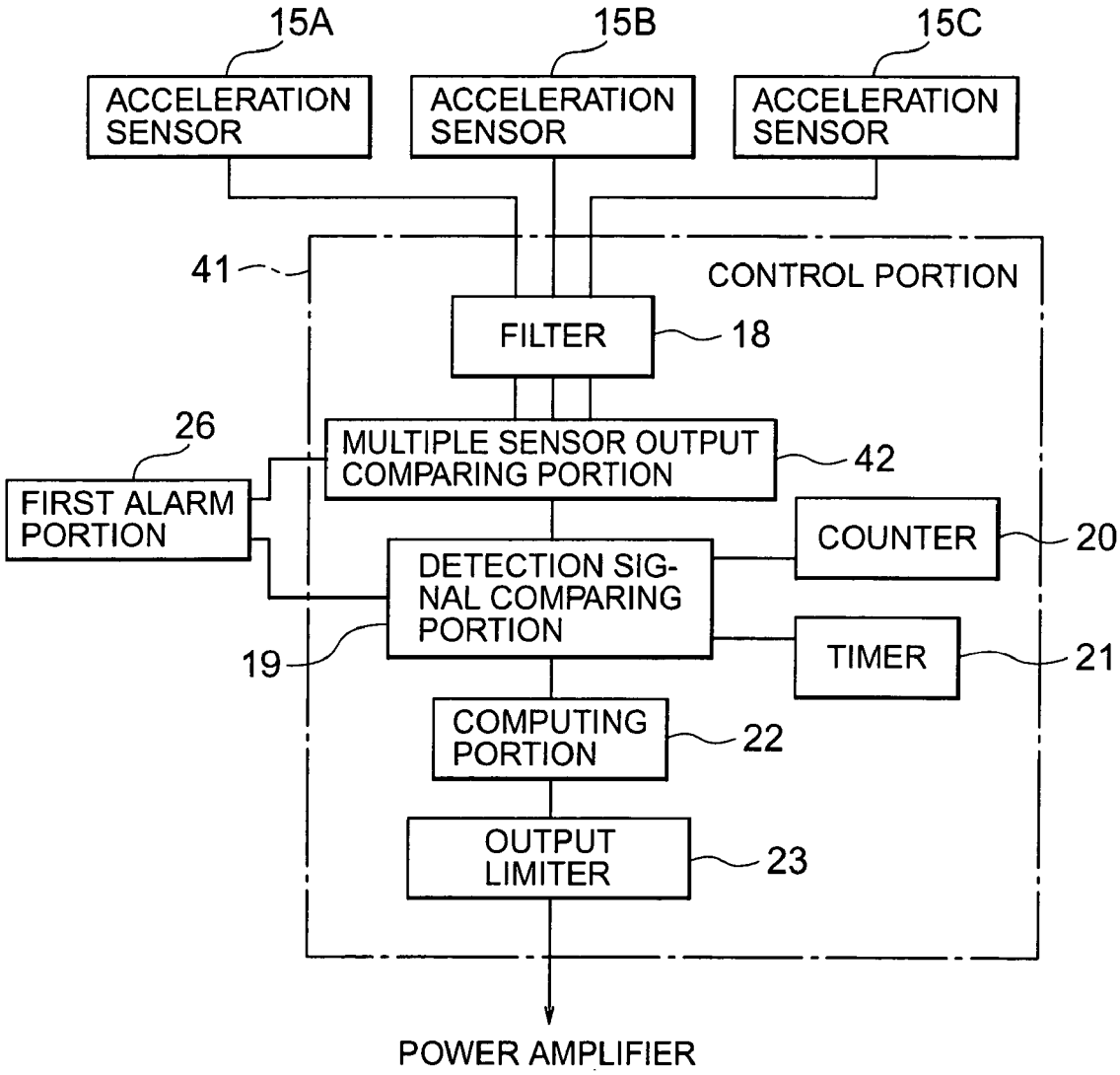
FIG. 7 is a block diagram showing a main portion of an elevator vibration reducing device according to Embodiment 3 of the present invention.

Next, FIG. 7 is a block diagram showing a main portion of an elevator vibration reducing device according to Embodiment 3 of the present invention. In this example, there are mounted on the car 3 a plurality of acceleration sensors 15A through 15C serving as vibration sensors for detecting the accelerations of the car 3 (FIG. 1) in the same horizontal direction. A control portion 41 has a filter 18, a detection signal comparing portion 19, a counter 20, a timer 21, a computing portion 22, an output limiter 23, and a multiple sensor output comparing portion 42.

Signals from the acceleration sensors 15A through 15C are input to the multiple sensor output comparing portion 42 through the filter 18. The multiple sensor output comparing portion 42 compares the acceleration detection signals from the acceleration sensors 15A through 15C to see if there is any failure in the acceleration sensors 15A through 15C. When it is determined by the multiple sensor output comparing portion 42 that the acceleration sensors 15A through 15C are out of order, the output from the control portion 41 to the power amplifier 17 or the output from the power amplifier to the electromagnetic actuators 13 is stopped to stop the active control, and, at the same time, an alarm is given by the first alarm portion 26 to the elevator control room, the elevator maintenance company or the like.

In this vibration reducing device, a plurality of acceleration sensors 15A through 15C for detecting accelerations in the same direction are used, and the output signals therefrom are compared with each other to see if there is any failure in the acceleration sensors 15A through 15C, so that it is possible to quickly detect a failure in the acceleration sensors 15A through 15C. Further, since signals having passed through the filter 18 are input to the multiple sensor output comparing portion 42, it is possible to compare signals from which high frequency components have been removed, making it possible to detect a failure in the acceleration sensors 15A through 15C more reliably.

When any abnormality is detected in the multiple sensor output comparing portion 42, the active control may be stopped completely. Further, as shown in the flowchart of FIG. 4, it is also possible to count the number of times that abnormality has been detected, and automatically recover active control when the number of times counted is less than a set number of times.

Embodiment 4

Figure 8:
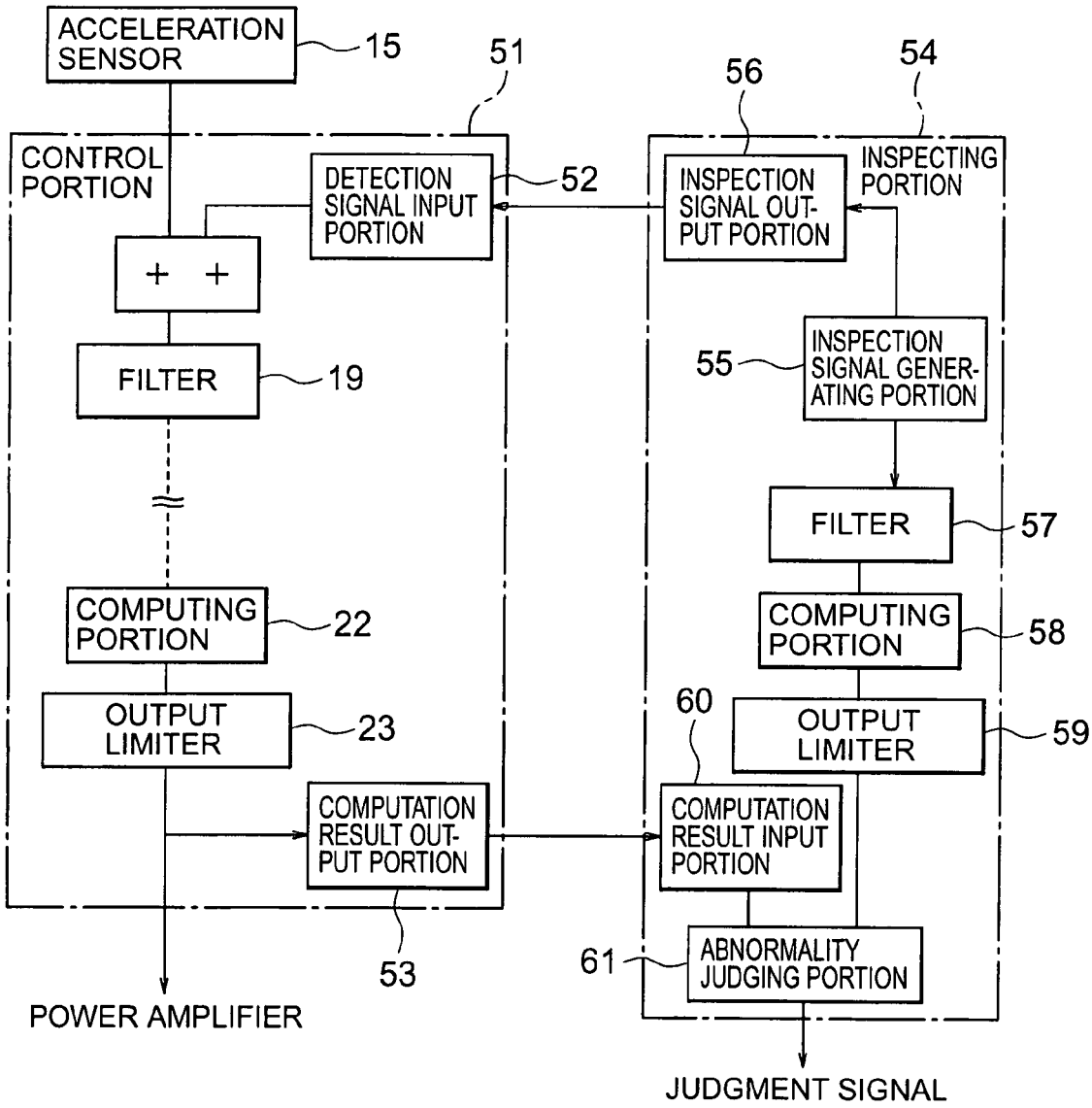
FIG. 8 is a block diagram showing a main portion of an elevator vibration reducing device according to Embodiment 4 of the present invention.

Next, FIG. 8 is a block diagram showing a main portion of an elevator vibration reducing device according to Embodiment 4 of the present invention. In the drawing, in addition to components similar to those of Embodiment 1, a control portion 51 has an inspection signal input portion 52 and a computation result output portion 53. An inspecting portion 54 has an inspection signal generating portion 55, an inspection signal output portion 56, a filter 57, a computing portion 58, an output limiter 59, a computation result input portion 60, and an abnormality judging portion 61.

An inspection signal generated in the inspection signal generating portion 55 is output to the inspection signal input portion 52 of the control portion 51 through the inspection signal output portion 56, and is also output to the computing portion 58 in the inspecting portion 54 through the filter 57. As in the case in which an acceleration detection signal is input from the acceleration sensor 15, when the inspection signal is input to the inspection signal input portion 52, the inspection signal undergoes computation processing, and a control signal is output to the electromagnetic actuators 13 through the power amplifier 17.

When an inspection signal is generated and a control signal is output while the car 3 is at rest, the car 3 is displaced through driving of the electromagnetic actuators 13, and the acceleration thereof is detected by the acceleration sensor 15. The acceleration detection signal from the acceleration sensor 15 at this time undergoes computation processing in the control portion 51, and is output as a computation result signal from the computation result output portion 53 to the computation result input portion 60 of the inspecting portion 54. The computation result signal input to the computation result input portion 60 is sent to the abnormality judging portion 61.

On the other hand, as in the control portion 51, the inspection signal also undergoes computation processing in the computing portion 58 in the inspecting portion 54, and is input to the abnormality judging portion 61. The computation result signal from the computation result input portion 60 and the computation result signal which has undergone computation processing in the inspecting portion 54 are compared with each other in the abnormality judging portion 61, whereby a judgment is made as to whether the elevator system is in the normal state or not. That is, in the abnormality judging portion 61, abnormality judgment is made by comparing the acceleration (vibration) detected by the acceleration sensor 15 when the inspection signal is output with the acceleration (vibration) obtained directly from the inspection signal.

In this vibration reducing device, when the elevator is not being used, for example, at midnight, the car 3 is stopped at a predetermined floor, and an inspection signal is generated by the inspection signal generating portion 55. This makes it possible to easily make a diagnosis of whether the active control system including the electromagnetic actuators 13, the acceleration sensor 15, the control portion 51, the power amplifier 17, and the mechanical portions such as the roller levers 9, operates in the normal fashion or not.

While Embodiments 1 through 4 adopt electromagnetic actuators, this should not be construed restrictively. It is also possible to use, for example, air actuators, hydraulic actuators, or linear motors.

Further, while in Embodiments 1 through 4 the acceleration sensor 15 is used as the vibration sensor, this should not be construed restrictively. It is also possible to use, for example, a displacement sensor for detecting horizontal displacement of the cage or a speed sensor for detecting the horizontal speed of the cage.

Figure 9:
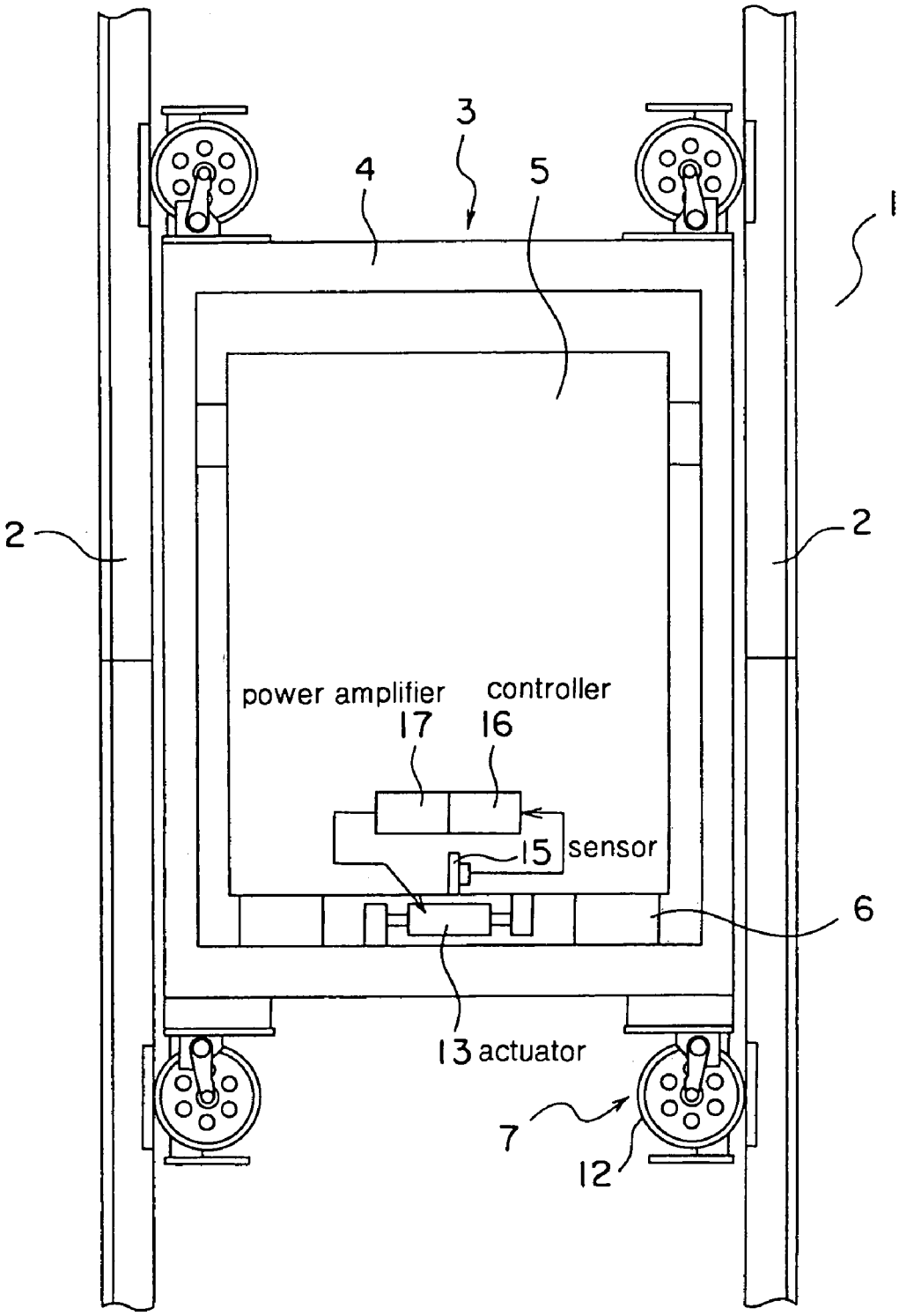
FIG. 9 is a front view of another arrangement example of the vibration reducing device of the present invention.
Figure 10:
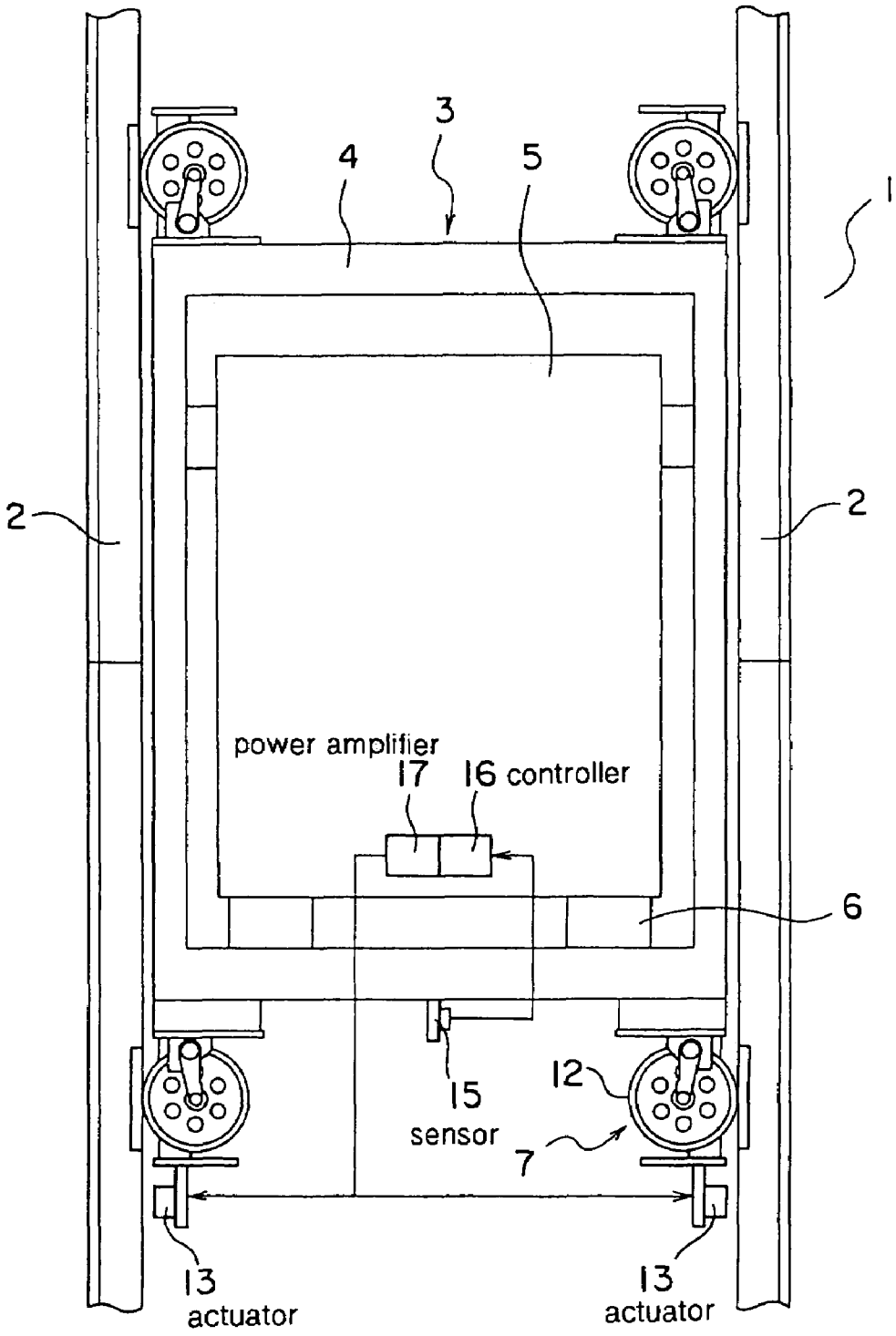
FIG. 10 is a front view of still another arrangement example of the vibration reducing device of the present invention.

Further, while in Embodiments 1 through 4 the vibration reducing device is incorporated in the roller guide device 7, it is also possible, as shown, for example, in FIGS. 9 or 10, to provide the vibration reducing device separately from the roller guide device 7.

That is, the vibration reducing device shown in FIG. 9 has the actuator 13 provided between the car frame 4 and the cage 5, the acceleration sensor 15 mounted in the cage 5, the control portion 16 mounted in the cage 5, and the power amplifier 17 mounted in the cage 5. Further, when horizontal vibration of the cage 5 is detected by the acceleration sensor 15, the cage 5 is displaced horizontally with respect to the car frame 4 so as to reduce the vibration.

The vibration reducing devices shown in FIG. 10 has the actuators 13 provided between the car frame 4 and the guide rails 2, the acceleration sensor 15 mounted on the car frame 4, the control portion 16 mounted in the cage 5, and the power amplifier 17 mounted in the cage 5. When horizontal vibration of the car 3 is detected by the acceleration sensor 15, the car 3 is displaced horizontally with respect to the guide rails 2 by the actuators 13 so as to reduce the vibration.

Further, as described above, the vibration sensor may be mounted directly in the cage, or mounted on the car frame to detect vibration of the car frame indirectly as vibration of the cage.

What is claimed is:

1. An elevator vibration reducing device comprising:

a vibration sensor for detecting horizontal vibration of a cage;

an actuator for displacing the cage horizontally; and a control portion including a computing portion for computing a vibration reduction control signal for reducing the horizontal vibration of the cage based on a vibration detection signal generated by the vibration sensor, and controlling the actuator, wherein the control portion includes a detection signal comparing portion for comparing a detection value obtained from the vibration detection signal with a set value, the control portion stopping controlling of the actuator when the detection value becomes not less than the set value, wherein the control portion temporarily stops controlling of the actuator upon detection of an abnormality and counts number of times that an abnormality has been detected, the control portion stopping control of the actuator completely when the number of times counted has attained a set number of times.

2. An elevator vibration reducing device comprising:

a vibration sensor for detecting horizontal vibration of a cage;

an actuator for displacing the cage horizontally; and a control portion including a computing portion for computing a vibration reduction control signal for reducing the horizontal vibration of the cage based on a vibration detection signal generated by the vibration sensor, and controlling the actuator; and a power amplifier between the actuator and the control portion and including an amplifier main body for amplifying the vibration reduction control signal, wherein the control portion includes current restricting means for restricting current output from the power amplifier to the actuator, and the power amplifier includes a current comparing portion which stops output of the vibration reduction control signal to the actuator when the current output from the power amplifier to the actuator is not smaller than a set value.

3. An elevator vibration reducing device comprising:

a vibration sensor for detecting horizontal vibration of a cage;

an actuator for displacing the cage horizontally; and a control portion including a computing portion for computing a vibration reduction control signal for reducing the horizontal vibration of the cage based on vibration detection signals generated by the vibration sensor, and controlling the actuator, wherein the control portion includes a plurality of detection signal comparing portions for comparing detection values obtained from the vibration detection signals with set values, and a branching portion assigning the vibration detection signals within respective frequency bands to respective detection signal comparing portions, and the set values in the detection signal comparing portions are different from each other according to the respective frequency bands, the control portion stopping controlling of the actuator when the detection values become not larger than the set values.

4. The elevator vibration reducing device according to claim 3, wherein the control portion temporarily stops controlling of the actuator upon detection of an abnormality and counts number of times that an abnormality has been detected, the control portion stopping control of the actuator completely when the number of times counted has attained a set number of times.

5. An elevator vibration reducing device comprising:

a plurality of vibration sensors, each vibration sensor detecting vibrations of a cage in a single, identical horizontal direction;

an actuator for displacing the cage horizontally; and a control portion including a computing portion for computing a vibration reduction control signal for reducing the horizontal vibrations of the cage based on vibration detection signals generated by the vibration sensors, and controlling the actuator, wherein the control portion includes a multiple sensor output comparing portion for detecting a failure of the vibration sensors by comparing to each other the respective vibration detection signals generated by the vibration sensors, the control portion stopping controlling of the actuator when the vibration sensors are determined to have failed.

6. The elevator vibration reducing device according to claim 5, wherein the control portion temporarily stops controlling of the actuator upon detection of an abnormality and counts number of times that an abnormality has been detected, the control portion stopping control of the actuator completely when the number of times counted has attained a set number of times.

7. An elevator vibration reducing device comprising:

a vibration sensor for detecting horizontal vibration of a cage;

an actuator for displacing the cage horizontally;

a control portion including a computing portion for computing a vibration reduction control signal for reducing the horizontal vibration of the cage based on a vibration detection signal generated by the vibration sensor, and controlling the actuator;

an inspecting portion including an inspection signal generating portion for outputting an inspection signal to the control portion to produce a drive signal for driving the actuator when the cage is at rest and producing a vibration detected by the vibration sensor, and an abnormality judging portion for detecting an abnormality by comparing a vibration, that is produced when the inspection signal is output for driving the actuator and that is detected by the vibration sensor, with an inspection vibration signal obtained by computation directly upon the inspection signal.

* * * * *